US008640373B2

(12) United States Patent
Burt

(10) Patent No.: US 8,640,373 B2
(45) Date of Patent: Feb. 4, 2014

(54) INTEGRATED SLING MOUNT AND RECOIL LUG

(75) Inventor: Eric C. Burt, Broomfield, CO (US)

(73) Assignee: Magpul Industrusties Corp., Erie, CO (US)

( * ) Notice: Subject to any disclaimer, the term of this patent is extended or adjusted under 35 U.S.C. 154(b) by 106 days.

(21) Appl. No.: 13/184,358

(22) Filed: Jul. 15, 2011

(65) Prior Publication Data

US 2012/0011758 A1 Jan. 19, 2012

Related U.S. Application Data

(60) Provisional application No. 61/364,742, filed on Jul. 15, 2010.

(51) Int. Cl.
*F41C 23/02* (2006.01)

(52) U.S. Cl.
USPC ..... 42/85

(58) Field of Classification Search
USPC ..... 42/85, 90
See application file for complete search history.

(56) References Cited

U.S. PATENT DOCUMENTS

| | | | | | |
|---|---|---|---|---|---|
| 2,040,150 | A | * | 5/1936 | Merrill | 124/16 |
| 2,078,010 | A | * | 4/1937 | Meepos | 42/85 |
| 2,771,699 | A | * | 11/1956 | Herter | 42/85 |
| 3,061,965 | A | * | 11/1962 | Lewis | 42/85 |
| 3,226,872 | A | * | 1/1966 | Pachmayr | 42/85 |
| 4,066,000 | A | * | 1/1978 | Rostocil | 89/198 |
| 4,553,469 | A | * | 11/1985 | Atchisson | 89/191.02 |
| 4,567,810 | A | * | 2/1986 | Preston | 89/142 |
| 4,654,993 | A | * | 4/1987 | Atchisson | 42/71.01 |
| 4,693,170 | A | * | 9/1987 | Atchisson | 89/149 |
| 4,807,512 | A | * | 2/1989 | Johansson | 89/1.4 |
| 4,864,761 | A | * | 9/1989 | Gregory | 42/75.01 |
| 5,575,411 | A | * | 11/1996 | Hightower | 224/149 |
| 5,613,316 | A | * | 3/1997 | Hightower | 42/85 |
| 6,260,748 | B1 | * | 7/2001 | Lindsey | 224/150 |
| 6,325,258 | B1 | * | 12/2001 | Verdugo et al. | 224/150 |
| 6,536,153 | B2 | * | 3/2003 | Lindsey | 42/85 |
| 6,598,330 | B2 | * | 7/2003 | Garrett et al. | 42/85 |
| D495,870 | S | * | 9/2004 | Verdugo | D3/215 |
| 7,082,709 | B2 | * | 8/2006 | Lindsey | 42/85 |
| D568,957 | S | * | 5/2008 | Esch | D22/108 |
| 7,398,616 | B1 | * | 7/2008 | Weir | 42/73 |
| 7,562,481 | B2 | * | 7/2009 | Esch | 42/85 |
| 7,814,697 | B2 | * | 10/2010 | Esch | 42/85 |
| 8,230,633 | B1 | * | 7/2012 | Sisk | 42/75.01 |
| 8,312,662 | B2 | * | 11/2012 | Rogers et al. | 42/85 |
| 2002/0020725 | A1 | * | 2/2002 | Verdugo et al. | 224/150 |
| 2002/0153393 | A1 | * | 10/2002 | Verdugo et al. | 224/150 |
| 2003/0110675 | A1 | * | 6/2003 | Garrett et al. | 42/85 |
| 2005/0034347 | A1 | * | 2/2005 | Verdugo | 42/85 |
| 2006/0254113 | A1 | * | 11/2006 | Esch | 42/85 |

(Continued)

*Primary Examiner* — Jonathan C Weber
(74) *Attorney, Agent, or Firm* — Geoffrey E. Dobbin; Dobbin IP Law P.C.

(57) ABSTRACT

A new sling mount for firearms is disclosed. The sling mount in particular also serves as a recoil lug for the firearm. At least one loop extends outward from the sling mount for use in attaching a sling. This passage may require a hole to be cut into the casing of the firearm for accommodation. The shape, size, contours and location of the sling mount will be dependent upon the intended weapon platform. In any event, the at least one loop provides attachment for a sling while also avoiding entanglement of the sling with a folding stock.

6 Claims, 5 Drawing Sheets

(56) References Cited

U.S. PATENT DOCUMENTS

2009/0288325 A1* 11/2009 Esch ..... 42/85
2010/0162609 A1* 7/2010 Rogers et al. ..... 42/85
2010/0287808 A1* 11/2010 King ..... 42/85
2011/0138671 A1* 6/2011 Rogers et al. ..... 42/85
2011/0239512 A1* 10/2011 Kleven ..... 42/85

* cited by examiner

INTEGRATED SLING MOUNT AND RECOIL LUG

FIELD OF THE INVENTION

The present invention relates to the field of firearms and more particularly relates to a recoil spring lug that features at least one integrated sling attachment loop.

BACKGROUND OF THE INVENTION

The invention of the personal long firearm provided a valuable tool for the user. However, carrying the firearm quickly became problematic. This problem led to the development of the sling. Early slings used a two point attachment to the firearm, usually at or near the stock and towards the fore end or barrel. Recently, sling systems have developed which attach at only one point of the firearm, usually at the juncture of the stock and receiver. This point is usually provided by an added sling plate, which is a thin plate of metal or other suitable material that fits between the stock and the receiver. A loop extends along the rim of the plate and toward one side or another of the firearm and provides an attachment point for the sling. Ambidextrous sling plates, those having loops on left and right sides of the firearm, provide two mounting options which may be useful in tactical scenarios or simply due to preference of the user. Another plate option has a transverse bar that crosses the face of the sling plate beneath the stock.

The folding stock is another advance in firearm technology. The folding stock is a stock which is hinged and will fold over one side of the firearm. Such stocks add convenience for carrying the firearm in a more compact state while also being easily deployed. However, the combination of a folding stock with a sling plate can be problematic as often the loop provided by the sling plate can block the motion of the folding stock and prevent stowage. This interference is assured if the sling plate is ambidextrous.

What is needed then is a mounting structure for a sling that will not interfere with a folding stock while being in an advantageous position. This structure needs to provide at least one sling mounting point with a preference for two, each being on either side of the firearm. Combining the sling mount with an existing piece of firearm hardware allows for drop in replacement while providing the intended benefit. One potential component for replacement is the recoil lug. The recoil lug provides a backstop against which the firearm's recoil spring may react in order to re-position the firearm's bolt carrier group for firing. In most firearms without a recoil buffer tube/receiver extension tube, this recoil lug is positioned above the stock in a rearward orientation of the firearm. This, then, provides an ideal location for positioning a sling mount, in particular an external loop.

An integrated recoil lug and sling loop represents a departure from the prior art in that it allows a single part to serve as both a recoil lug and a sling attachment loop simultaneously. The integrated part also allows for the use of a rearward sling mounting point on long firearms with a folding stock.

SUMMARY OF THE INVENTION

In view of the foregoing disadvantages inherent in the known types of sling mounts, this invention provides a sling mount that is useful for folding stocks and also serves as a recoil lug for the recoil spring. As such, the present invention's general purpose is to provide a new and improved sling mount that is easily incorporated into an existing system by replacing the system's recoil lug.

To accomplish these objectives, the sling mount comprises a lug body shaped in general conformity to a given weapon platform's recoil lug. At least one sling loop radially projects along a perimeter of the lug body. Accommodating the sling mount may require adaptation of the firearm in that the outer casing of the upper receiver may have to be cut to allow the at least one sling loop passage. Weapon functionality is preserved because the sling mount is shaped, sized and formed in a manner to replace the recoil lug of an existing or later developed weapon system.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the integrated sling mount and recoil lug is herein described. It should be noted that the articles "a", "an", and "the", as used in this specification, include plural referents unless the content clearly dictates otherwise.

With reference to FIGS. 1-6, an example of a combination sling mount and recoil lug 10 is depicted. It should be noted that the depicted combination sling mount and recoil lug is fashioned for a Bushmaster ACR rifle. As such its contours, size and construction are dictated by the rifle. It stands to reason that for different rifles, different shapes, sizes, part orientations, locations relative to the firearm and variations will therefore follow and still be considered within the scope of the present invention. No limitation with respect to the specific embodiment disclosed herein is intended or should be inferred.

Figure 1:
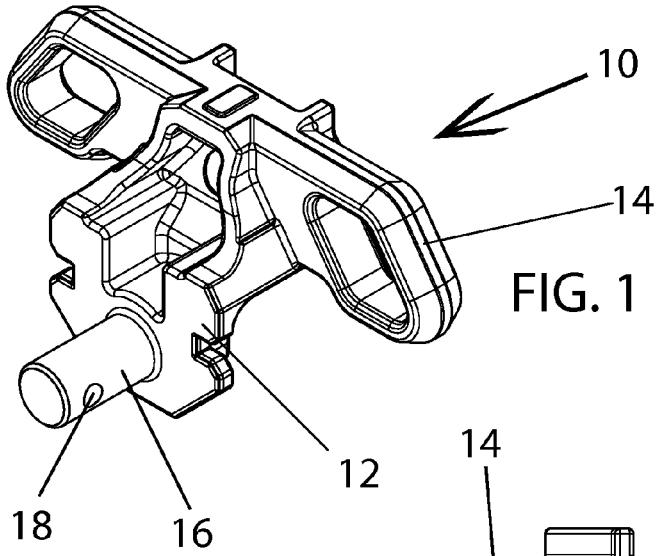
FIG. 1 is a perspective view of a sling mount according to one embodiment of the present invention.
Figure 2:
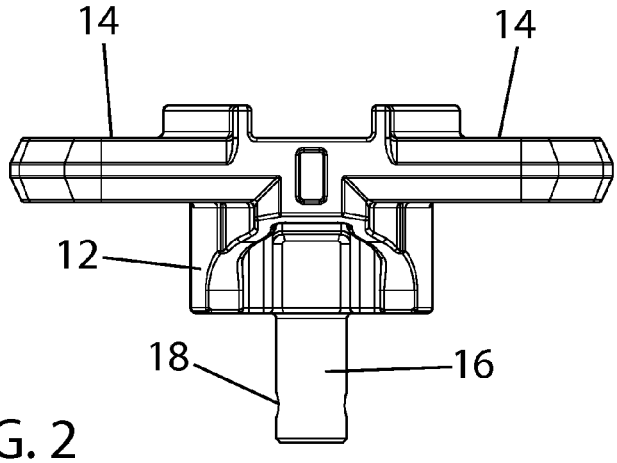
FIG. 2 is a top plan view of the sling mount of FIG. 1.
Figure 3:
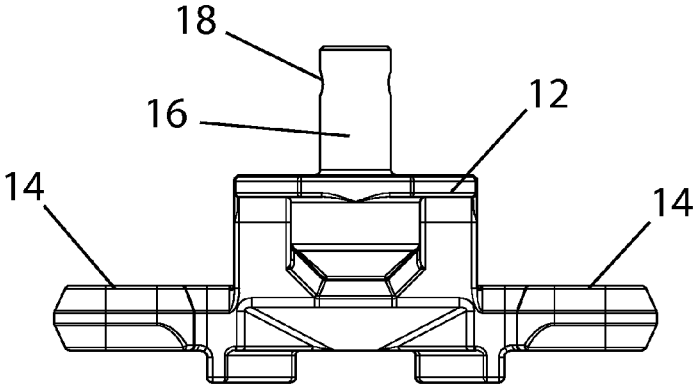
FIG. 3 is a bottom plan view of the sling mount of FIG. 1
Figure 4:
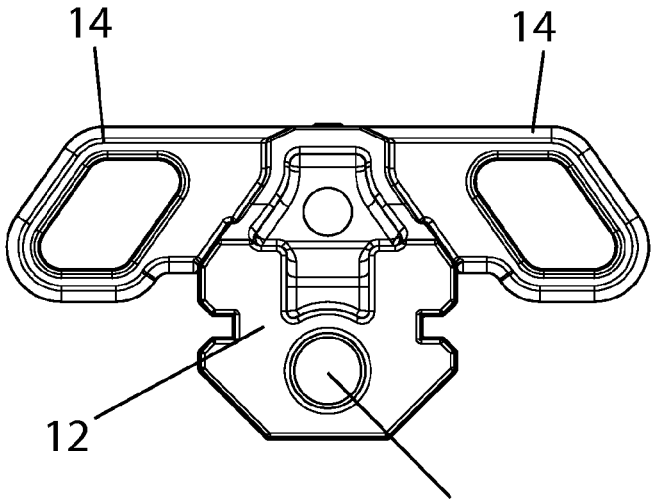
FIG. 4 is a front elevation of the sling mount of FIG. 1.
Figure 5:
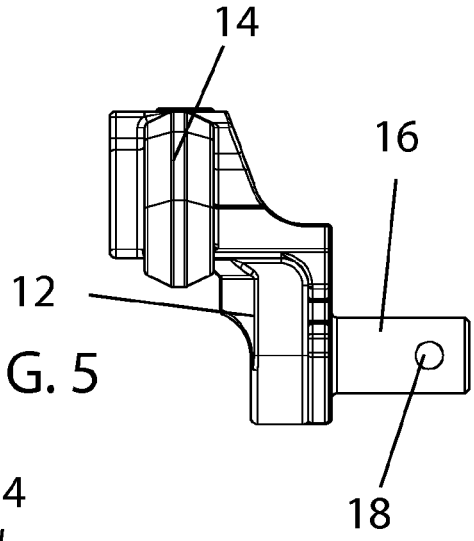
FIG. 5 is a right elevation of the sling mount of FIG. 1, the left elevation being a mirror image thereof.
Figure 6:
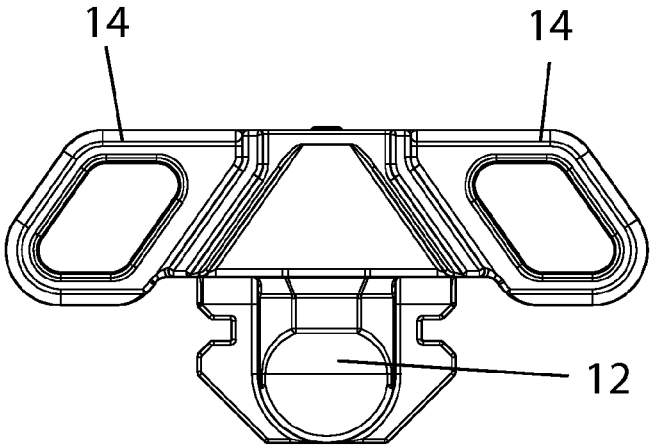
FIG. 6 is a rear elevation of the sling mount of FIG. 1.
Figure 7:
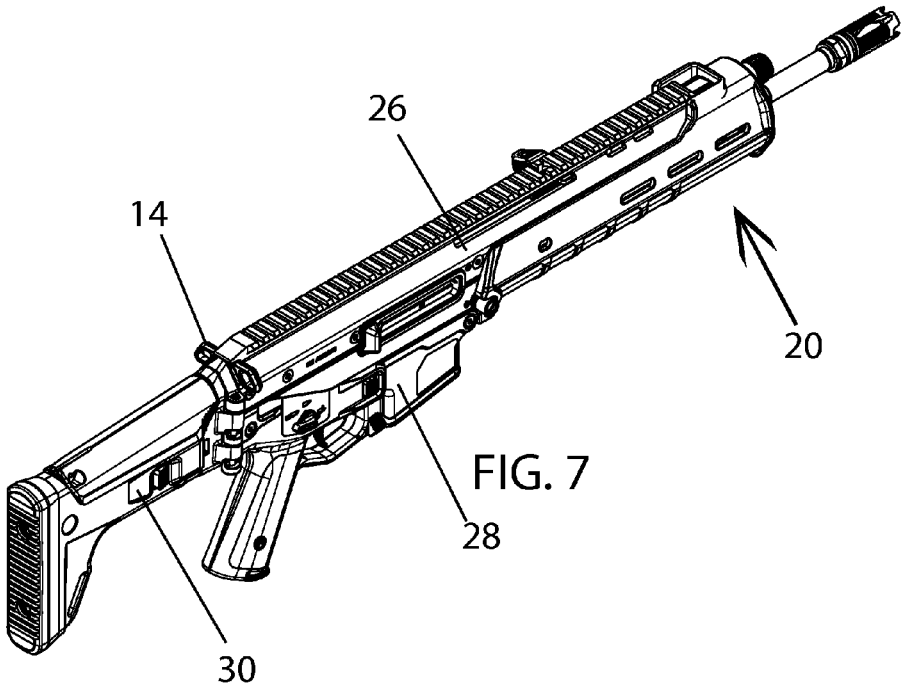
FIG. 7 is a perspective view of a firearm utilizing the sling mount of FIG. 1.
Figure 8:
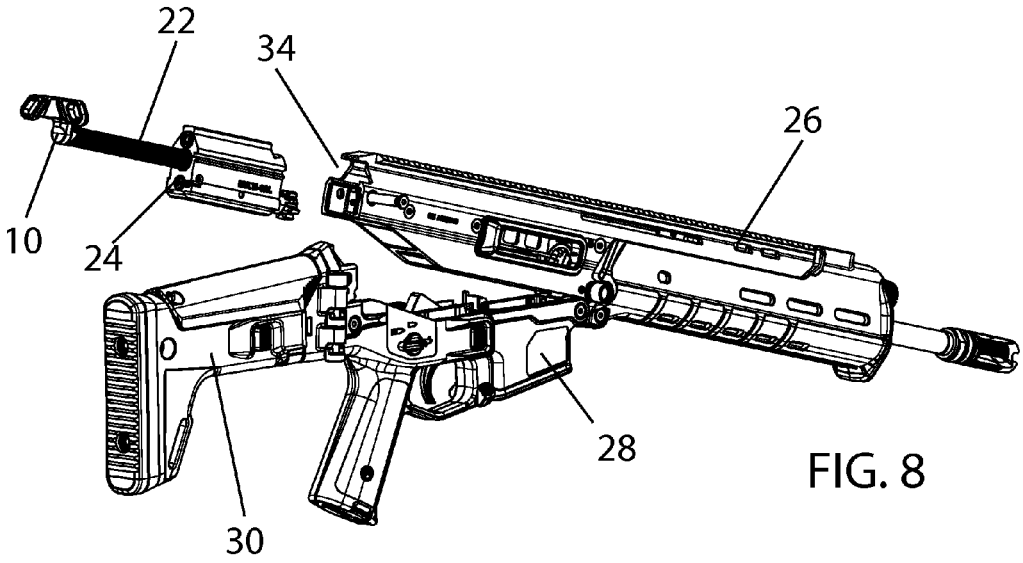
FIG. 8 is a perspective view of the firearm of FIG. 7, partially disassembled.

In the depicted embodiment, the sling mount 10 features a spring guide rod connection post 16 projecting from a lug core 12 and presenting a hole 18 for the fastening of a recoil spring guide rod thereto. The spring guide rod connection post 16 is then coaxial with the recoil spring and guide rod and together they define an axis, about which the lug core 12 may be said to be eccentrically mounted, with the majority of its mass above the axis. Lug core 12 is ideally made to key into the interior structure of the weapon's upper receiver. This then prevents any rotation or other movement of the lug core 12 inside the firearm. As it is made to key into the receiver, the lug core may be of any shape, as dictated by the receiver. At least one sling loop 14 extends outwardly from the lug core 12, generally perpendicular to the axis, and projects through the casing of the upper receiver 26 of a firearm 20, as shown in FIG. 7. In the depicted firearm, the sling mount 10 is located before the stock 30 and above the lower receiver 28. As shown in FIG. 8, the sling mount 10 abuts spring 22 and it thereby connects to the bolt carrier group 24. In operation of the firearm, the bolt carrier group 24 recoils from the explosion of a round of ammunition and impinges the spring 22. This then compresses the spring 22 against the sling mount 10 and stores energy for use in returning the bolt carrier group 24 into its firing position. Since the spring is physically connected to the sling mount, the sling mount 10 also serves to aid in the removal of the spring 22 and bolt carrier group 24 from the firearm during disassembly.

Figure 9:
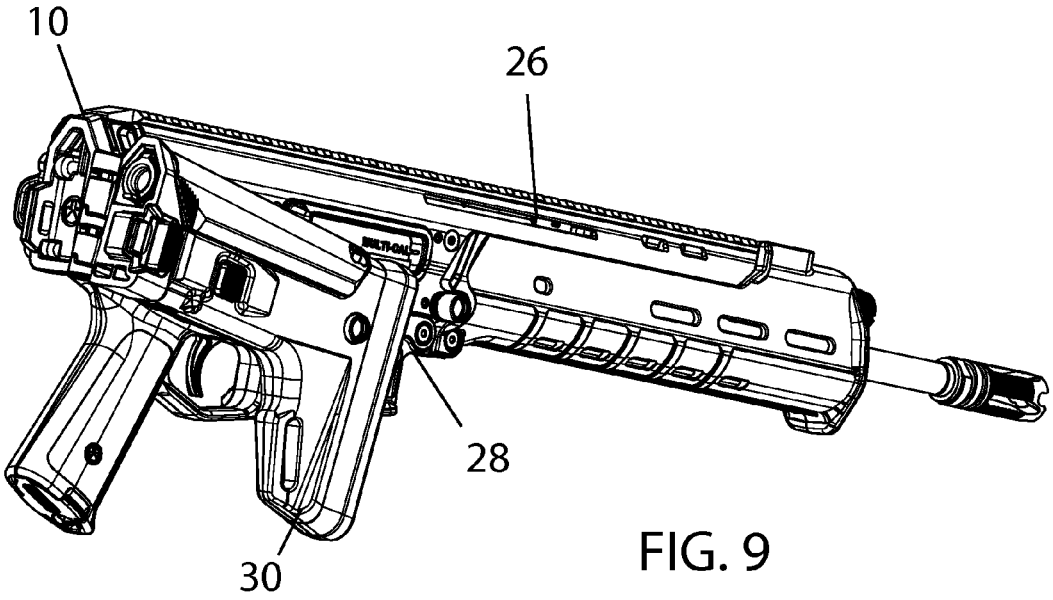
FIG. 9 is a perspective view of the firearm of FIG. 7, having the stock folded into a stowed position.
Figure 10:
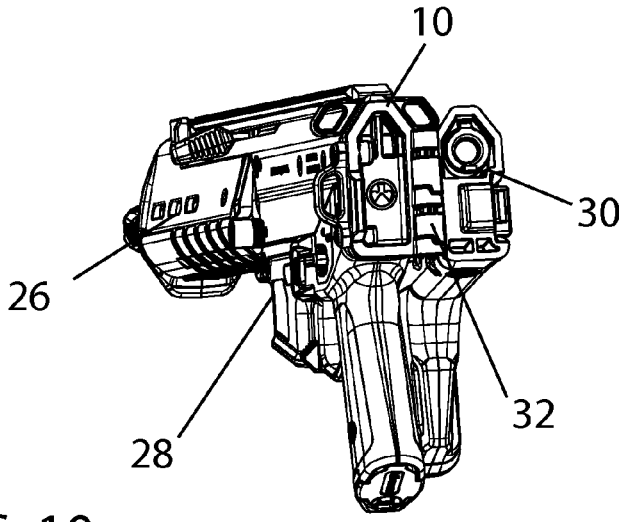
FIG. 10 is a rear perspective view of the firearm of FIG. 9.
Figure 12:
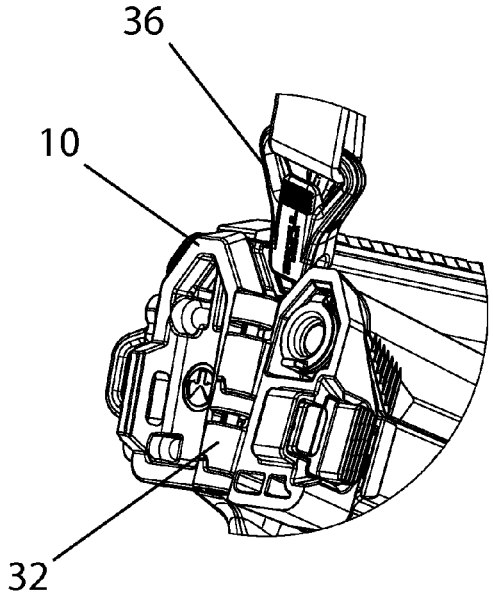
FIG. 12 is a close-up view of the firearm of FIG. 11, taken in circle A.
Figure 11:
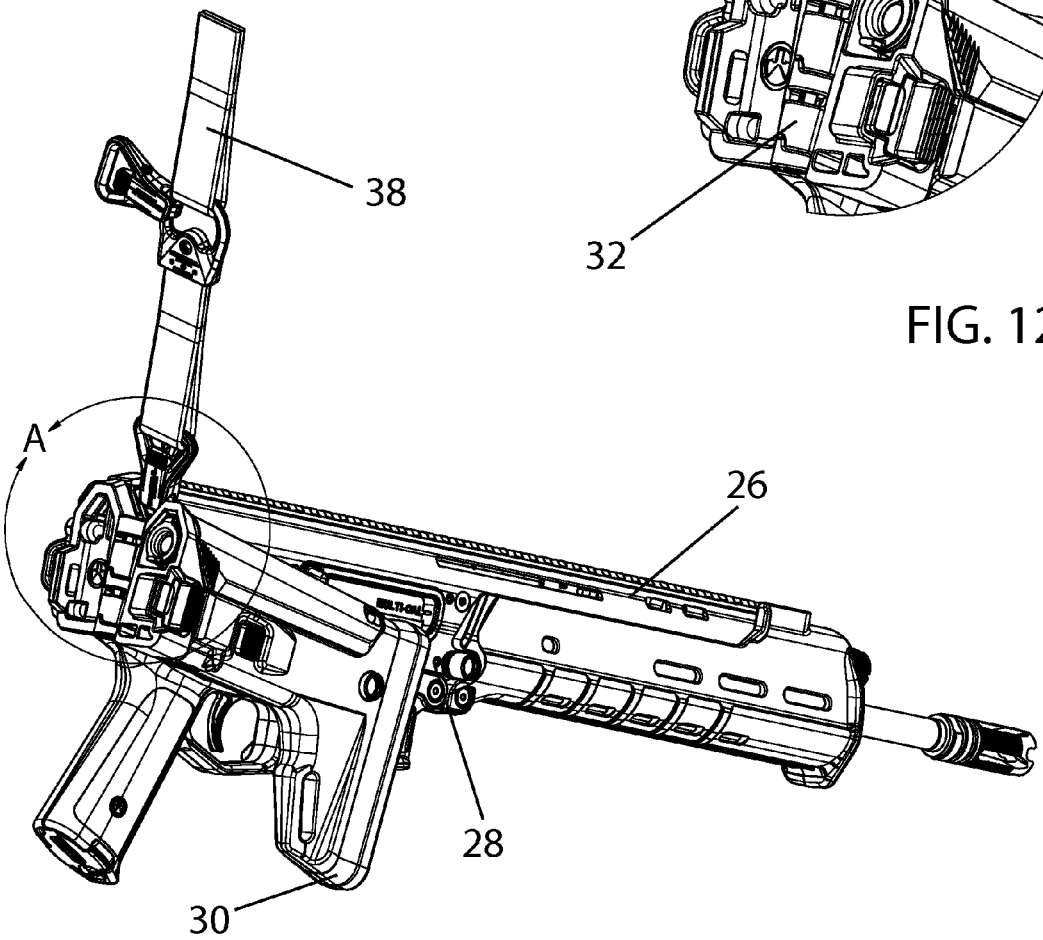
FIG. 11 is a perspective view of the firearm of FIG. 9, with a sling attached to the sling mount.

FIGS. 9-12 depict the auxiliary purpose of the sling mount and recoil lug combination. The stock 30 folds along hinge 32, as shown in FIGS. 9 and 10. Such an action would block a traditional sling mount or would allow the stock to become entangled in an attached sling. With the improved sling mount and recoil lug, the sling 38 attaches with a clip 36 to a sling loop 14 of the sling mount 10 and is located away from (ideally above) the folding stock 30. The sling loops 14 are accommodated by a pair of slots 34 cut into the casing of the upper receiver (FIG. 8). It is, of course, also conceivable to manufacture a rifle with such accommodation slots. While depicted with two sling loops 14, it is also readily apparent that a single sling loop may be utilized in the present invention It should be noted that the depicted combination sling mount and recoil lug is fashioned for a Bushmaster ACR rifle. As such its contours, size and construction are dictated by the rifle. It stands to reason that for different rifles, different shapes, sizes, part orientations, locations relative to the firearm and variations will therefore follow and still be considered within the scope of the present invention. No limitation with respect to the specific embodiment disclosed herein is intended or should be inferred.

What is claimed is:

1. A combination sling mount and recoil lug for a firearm comprising:

a. a lug core shaped and sized to reside between a receiver and a butt stock of a given firearm, said lug core having an axis defined by an associated recoil spring and a perimeter; and b. at least one sling loop extending outward from the perimeter, essentially perpendicular to the axis such that the at least one sling loop will extend outside of and from between the receiver and butt stock when the combination sling mount and recoil lug is installed thereon.

2. The combination sling mount and recoil lug of claim 1, further comprising a spring guide rod connection post, extending from the lug core along the axis and serving as a connection point for the associated recoil spring guide rod.

3. The combination sling mount and recoil lug of claim 2, the lug core specifically shaped to key into an interior of the receiver casing.

4. The combination sling mount and recoil lug of claim 1, the lug core specifically shaped to key into an interior of the receiver casing.

5. A combination sling mount and recoil lug for a firearm comprising:

a. a lug core shaped and sized to generally conform the specifications of a recoil lug for a given firearm, said lug core having an axis defined by an associated recoil spring and a perimeter;

b. at least one sling loop extending outward from the perimeter, essentially perpendicular to the axis; and c. a spring guide rod connection post, extending from the lug core along the axis and serving as a connection point for the associated recoil spring guide rod;

wherein the at least one sling loop extends outside a receiver casing for the firearm, when the combination sling mount and recoil lug is installed therein.

6. The combination sling mount and recoil lug of claim 5, the lug core specifically shaped to key into an interior of the receiver casing.

* * * * *